United States Patent [19]

Harms et al.

[11] Patent Number: 4,666,360

[45] Date of Patent: May 19, 1987

[54] FORKLIFT LINKAGE DEVICE

[75] Inventors: John R. Harms; Ronald L. Anderson, both of Burlington, Iowa

[73] Assignee: J. I. Case Company, Racine, Wis.

[21] Appl. No.: 803,167

[22] Filed: Dec. 2, 1985

[51] Int. Cl.[4] ..... B66F 9/12

[52] U.S. Cl. ..... 414/607; 187/9 R; 414/695.5; 414/722

[58] Field of Search ..... 414/607, 608, 785, 694, 414/695, 695.5, 722; 187/9 R

[56] References Cited

U.S. PATENT DOCUMENTS

| | | | |
|---|---|---|---|
| 2,707,573 | 5/1955 | Balwics | 414/608 |
| 3,207,085 | 9/1965 | Burr | 414/607 X |
| 3,298,547 | 1/1967 | Williams | 414/695 |
| 3,353,697 | 11/1967 | Martin et al. | 414/607 |
| 3,415,339 | 12/1968 | Range | 414/607 X |
| 3,587,893 | 6/1971 | Laken | 414/607 |
| 3,863,786 | 2/1975 | Frank | 414/607 X |
| 4,065,013 | 12/1977 | Orthman | 414/785 X |
| 4,149,644 | 4/1979 | Fuller | 414/607 |
| 4,395,188 | 7/1983 | Kaup | 414/785 X |
| 4,579,504 | 4/1986 | Lemme et al. | 414/607 |

FOREIGN PATENT DOCUMENTS

| | | | |
|---|---|---|---|
| 2306930 | 11/1976 | France | 414/607 |
| 1604002 | 12/1981 | United Kingdom | 414/686 |

*Primary Examiner*—Frank E. Werner
*Attorney, Agent, or Firm*—Peter N. Jansson

[57] ABSTRACT

An improved forklift linkage device of the type engageable with the forwardly-extending forklift tines. The linkage device includes a horizontal frame having a front tool-supporting portion and a rear securing portion extending rearwardly therefrom at a lower level to a rear edge. Tine-receiving channels extend forwardly from a position forward of the rear edge, and the securing portion has portions designed to interlock with the vertical standard of the forklift when the linkage device is raised on the fork.

9 Claims, 9 Drawing Figures

FORKLIFT LINKAGE DEVICE

FIELD OF THE INVENTION

This invention is related generally to devices for attachment of auxiliary tools or equipment to forklifts and, more particularly, to forklift linkage devices engageable with the fork tines.

BACKGROUND OF THE INVENTION

A variety of linkage devices have been developed in the prior art for joining forklifts with auxiliary implements of various kinds. Such devices are intended to eliminate the need to have a number of separate wheeled vehicles (or trucks) for equipment performing different tasks.

Some examples of prior forklift linkage devices are disclosed in U.S. Pat. Nos. 4,243,354 (Garcia), 2,873,873 (Fowler), 2,364,493 (Ulinski), 3,788,492 (Kraft), 3,258,146 (Hamilton), 4,318,661 (Laken) and 4,065,013 (Orthman).

Each of these prior devices is engagable with the forwardly-extending tines of a forklift fork of the type movable vertically along the erect forklift slide frame structure, which will be referred to herein as a standard. Many such devices of the prior art provide an inadequate interengagement with the forklift for heavy work of various kinds.

For example, if heavy digging and scraping is done by the auxiliary equipment attached to a forklift, there can be a tendency for the linkage device to disconnect or be pulled off the fork tines. This tendency would exist if the auxiliary equipment is a backhoe, since such equipment does its work at such a distance from what would be the point of attachment to the forklift. And, when a substantial weight is to be carried at a distance by the auxiliary tool, a firmer interengagement between auxiliary tool and forklift is required than has been provided by devices of the prior art.

Some prior art devices engage the fork tines at a disadvantageous position. It is highly preferred to apply the work or loading pressure of the auxiliary tool or equipment onto the forklift as close to its center of gravity as possible and at as low a position as possible. The devices of the prior art have not been satisfactory in this regard.

One practice widely used in the prior art for installation of implements on forklift trucks involves the removal of the fork or, in some cases, of the fork and the standard along which it travels. This process is cumbersome and time consuming. However, the tine-engaging devices of the prior art have been inadequate substitutes for the reasons given above.

It is clear that there is a need for a simple and effective forklift linkage device of the type engageable with the forklift tines.

BRIEF SUMMARY OF THE INVENTION

This invention is an improved forklift linkage device of the type engageable with the forwardly-extending tines of the fork. The forklift linkage device of this invention overcomes some problems and deficiencies of the prior art, including those mentioned above.

The invention includes a horizontal frame having a front tool-supporting portion and a rear securing portion which terminates in a rear edge. On the frame there are a pair of tine-receiving channels which extend forwardly from rearwardfacing openings which are positioned forward of the rear edge. The securing portion includes means adjacent to the rear edge for interlocking with the lower portions of the vertical slide frame, or standard, of the forklift.

In preferred embodiments, the interlocking means are mating members which are rearward of and at a level lower than the channel openings. Such interlocking means are configured and positioned for vertical engagement with the lower ends of the uprights forming the forklift standard (slide frame). Such vertical engagement is effected by raising the fork along the standard, in the normal fashion, until the interlocking means engage the uprights.

In highly preferred embodiments, the mating members on the securing portion of the horizontal frame are upwardly-facing recesses which receive the lower ends of the standard. There are preferably two such recesses, each adjacent to one of the tine-receiving channels, although at a lower level.

In some preferred embodiments, the mating members may be upwardly-facing protuberances on the securing portion positioned for insertion into openings in the lower ends of uprights forming the vertical standard of the forklift. Such insertion for interlocking occurs when the horizontal frame is raised on the fork until the protuberances are fully inserted.

The front tool-supporting and rear securing portions of the horizontal frame are preferably upper and lower substantially planar portions, respectively, which are joined together in partially overlapping fashion. When the linkage device of this invention is engaged with a forklift, the lower planar portion is at a level below the forklift tines and extending rearwardly to a position beneath the vertical standard of the forklift. This places the interlocking means in position for engagement with the lower ends of the uprights of the forklift standard.

The upper planar portion, or tool-supporting portion, is preferably formed by the tine-receiving channels and one or more cross members which hold the tine-receiving channels at the proper spacing. The lower planar portion, or rear-securing portion, is preferably a frame having two parallel members in offset alignment with the tine-receiving channels.

When upwardly extending protuberances on the securing portion are used as the means for interlocking with the uprights of the forklift standard, the securing portion of the horizontal frame is preferably angled to a lower level near its rear edge such that the protuberances are completely below the level of the tine-receiving channels. This eliminates any interference between the protuberances and the forklift tines when the linkage device of this invention is mounted onto the fork.

The horizontal frame, including the tine-receiving channels, are preferably formed of structural tubes of rectangular cross-section. Structural members of steel are highly preferred.

The interengagement of the rear-securing portion with the lower ends of the vertical standard allows a substantial loading on the tool-supporting portion. This allows the load to be received on the forklift structure at a location which is very low and much closer to the center of gravity of the forklift than was possible with linkage devices of the prior art.

In a highly preferred application of this invention, a backhoe is affixed to the front tool-supporting portion of the forklift linkage device. The scraping and lifting action of a backhoe does not interfere with the firm engagement provided by the forklift linkage device of this invention. The linkage can also be used for attachment of a variety of other implements to a forklift.

OBJECTS OF THE INVENTION

It is an object of this invention to provide an improved forklift linkage device overcoming some of the problems and shortcomings of devices of the prior art.

Another object of this invention is to provide an improved forklift linkage device which does not require removal of the forklift standard and/or its fork.

Another object of this invention is to provide a forklift linkage device which gives firm attachment for a variety of auxiliary implements, including scraping and lifting devices such as backhoes.

Another object of this invention is to provide an inexpensive backhoe not requiring a dedicated wheeled vehicle or truck.

Yet another object of this invention is to provide a forklift linkage device which firmly engages an auxiliary implement even during heavy work conditions.

Still another object of this invention is to provide an improved forklift linkage device which may be easily and quickly attached to a forklift.

These and other objects will be apparent from the following additional descriptions and from the drawings, wherein:

DETAILED DESCRIPTION OF PREFERRED EMBODIMENTS

Figure 8:
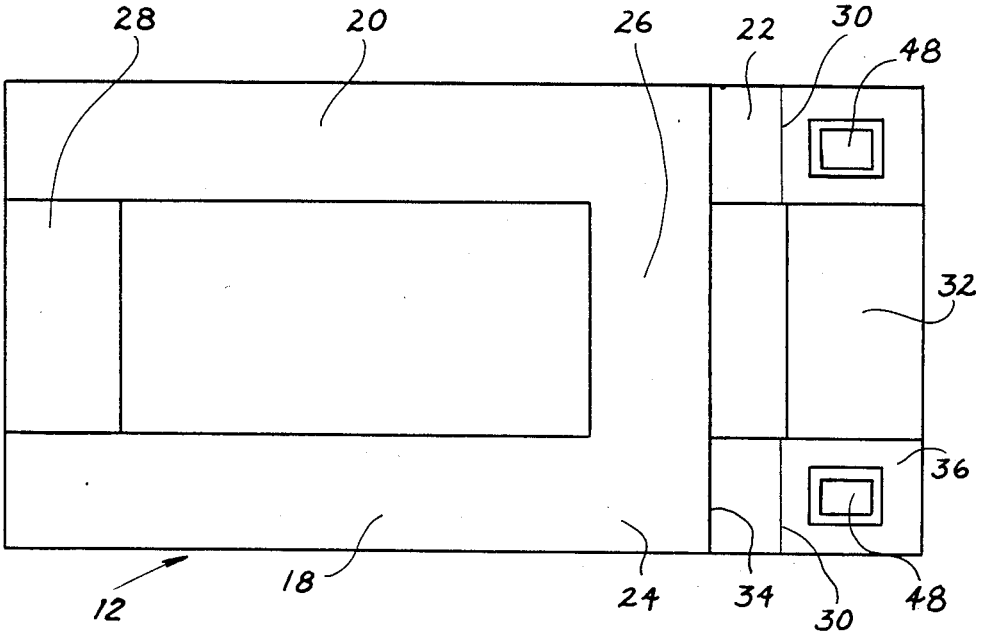
FIG. 8 is an enlarged plan view, as in FIG. 3, but showing an alternate embodiment of the linkage of this invention.
Figure 9:
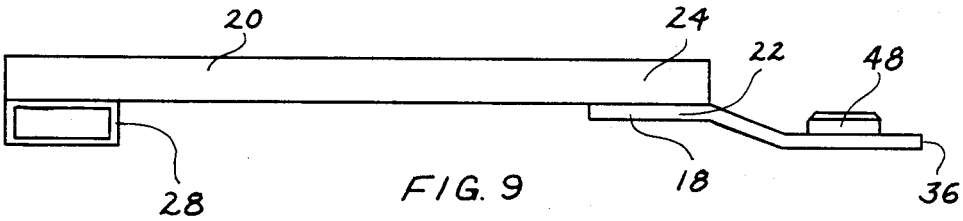
FIG. 9 is a side elevation of FIG. 8.

FIGS. 1–7 illustrate a preferred linkage device 10 of this invention. FIGS. 8 and 9 illustrate a linkage device 12 which is an alternate embodiment of the invention. Similar parts will be identified by the same numbers.

Figure 1:
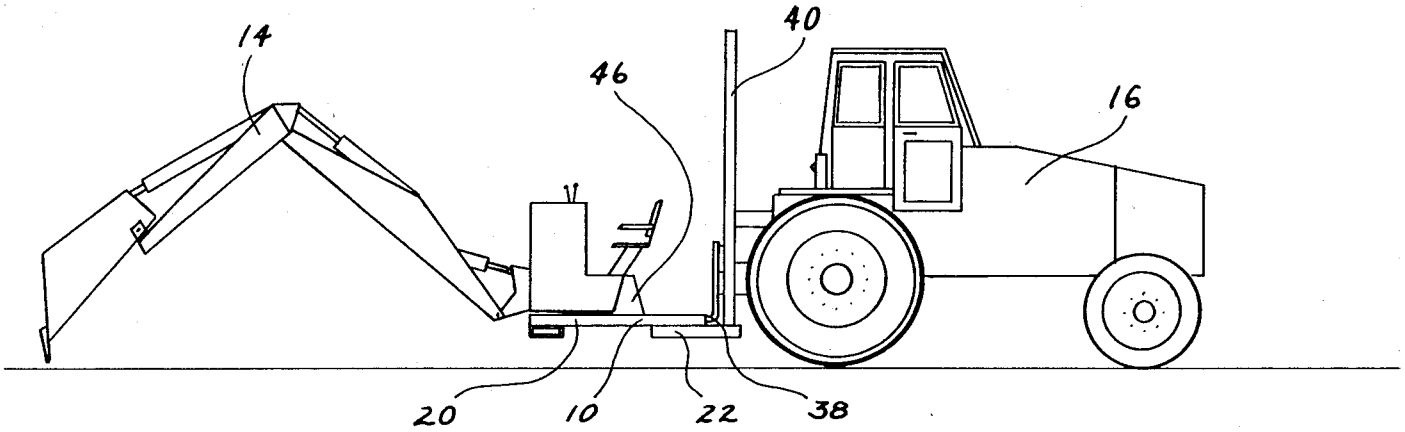
FIG. 1 is a side elevation of a forklift with an auxiliary backhoe attached to it by a linkage device in accordance with this invention.

Linkage device 10 is shown in FIG. 1 as linking an auxiliary backhoe 14 to a forklift 16. Linkage device 10 may be used to join a variety of different implements to forklift 16.

Linkage device 10 is a horizontal frame 18, preferably made of structural rectangular steel tubular members which are welded together. Horizontal frame 18 includes a front tool-supporting portion 20 and a rear securing portion 22. The entire structure is rigid and has no moving parts.

Tool-supporting portion 20 has two tine-receiving channels 24 which are parallel. Cross members 26 and 28 hold tine-receiving channels 24 in the proper spaced relationship.

Securing portion 22 has two parallel members 30 which are held in spaced relationship by a cross member 32. Parallel members 30 are in vertically offset alignment with tine-receiving channels 24.

Tool-supporting portion 20 and securing portion 22 form upper and lower planar portions, respectively, of horizontal frame 18. They are joined in partially overlapping fashion by attachment of the upper surfaces of parallel members 30 to the lower surfaces of tine-receiving channels 24. Securing portion 22 extends in a rearward direction from a position just below the open ends 34 of tine-receiving channels 24. Securing portion 22 terminates in a rear edge 36.

Figure 6:
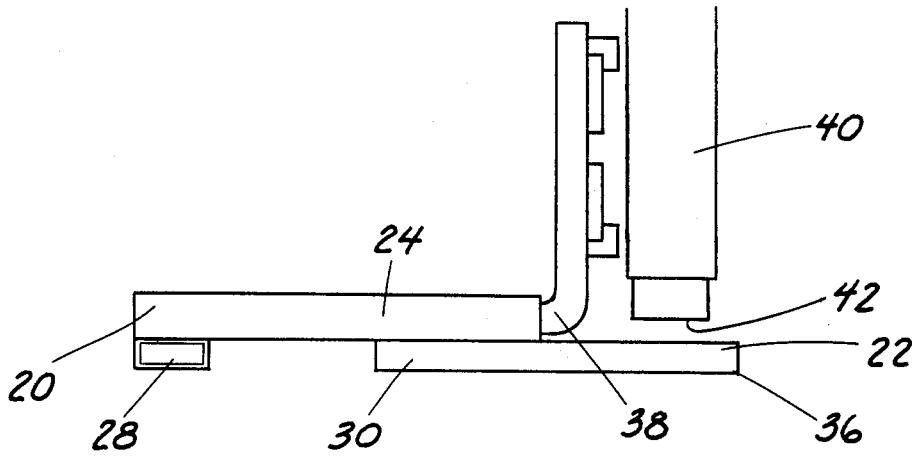
FIG. 6 is a fragmentary side elevation as in FIG. 5, but showing the forklift and linkage device partially attached.

The openings 34 of tine-receiving channels 24 are forward of rear edge 36, and channels 24 extend from such openings in a forward direction. When the tines 38 of a forklift fork are inserted in tine-receiving channels 24, securing portion 22 of horizontal frame 18 extends under the uprights 40 of the forklift standard, as illustrated in FIG. 6.

Figure 7:
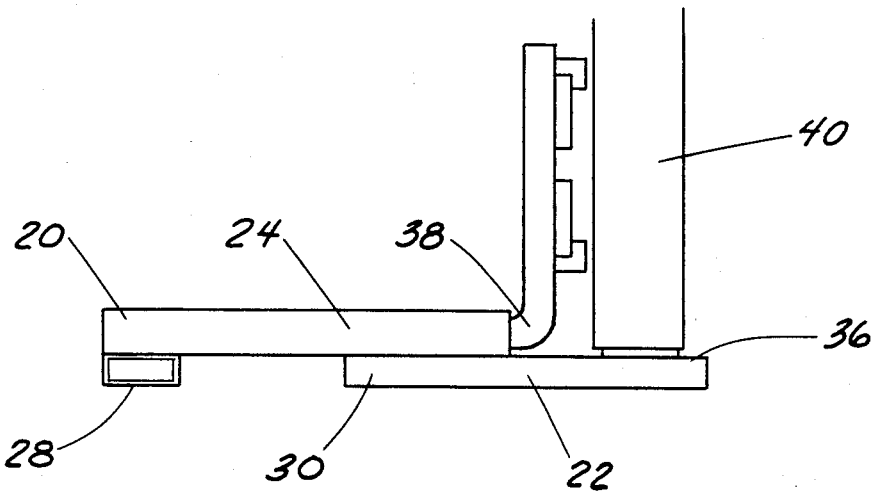
FIG. 7 is a fragmentary side elevation as in FIG. 5, but showing the forklift and linkage device in complete engagement.

After tines 38 are fully inserted, the forklift fork and linkage device 10 supported thereon will be lifted by means of the standard forklift lifting action until securing portion 22 comes into engagement with the lower ends 42 of uprights 40, as illustrated in FIG. 7.

Lower ends 42 of uprights 40 and securing portion 22 have interlocking means to facilitate such engagement. As illustrated best in FIGS. 2 and 3, two upwardly-facing recesses 44 are on securing portion 22 adjacent to rear edge 36. Recesses 44 are shaped and located to mate with lower ends 42, which are received into recesses 44 when linkage 10 is lifted along the forklift standard. The fully linked position is illustrated in FIG. 1 as well as in FIG. 7.

Figure 2:
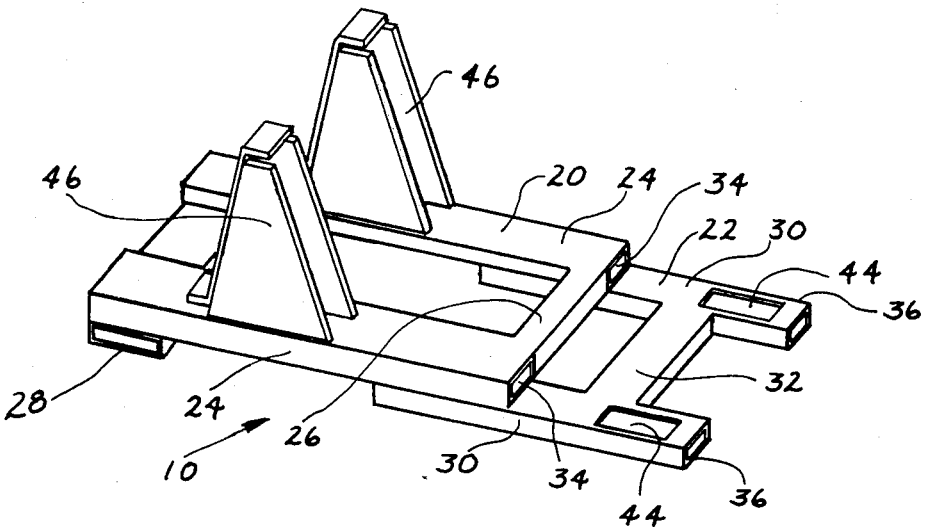
FIG. 2 is a perspective view of the linkage device of this invention.
Figure 3:
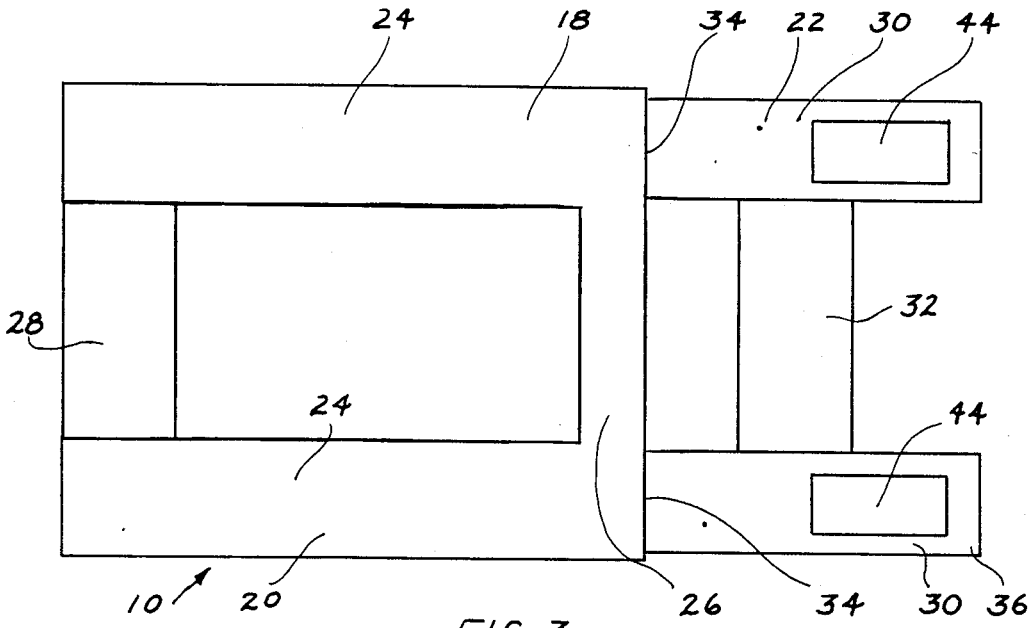
FIG. 3 is an enlarged plan view of the linkage device of FIG. 2.
Figure 4:
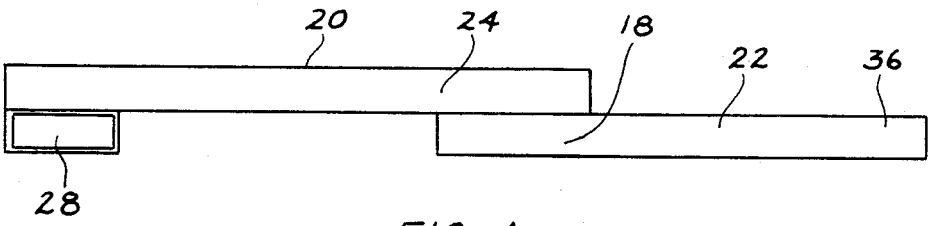
FIG. 4 is an side elevation of FIG. 3.
Figure 5:
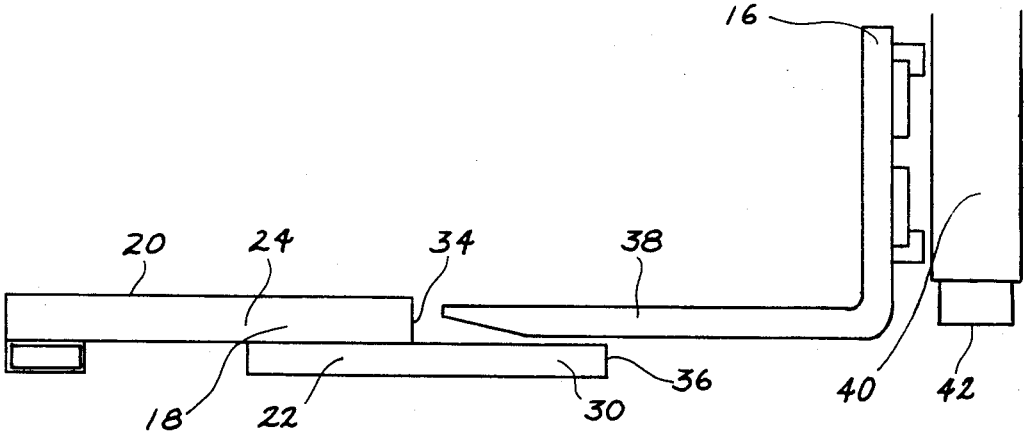
FIG. 5 is a fragmentary side elevation of a forklift in position to be attached to the linkage device.

FIGS. 1 and 2 show two upright mounting structures 46 which are welded on the upper surfaces of tine-receiving channel members 24. These are designed for easy engagement with a backhoe 14 or other auxiliary implement. Upright mounting structures 46 are not shown in any of the other figures. A variety of mounting structures can be placed on linkage device 10.

Linkage device 12, shown in FIGS. 8 and 9, is an alternate preferred embodiment of the invention. Instead of having recesses on securing portion 22 to receive lower ends 42 of uprights 40, linkage device 12 has two protuberances 48 in the same position as the recesses. Protuberances 48 are located and designed to be received into openings in lower ends 42 of uprights 40. This structure is an effective means for interlocking the linkage device to the forklift.

A variety of interlocking means can be placed on securing portion 22. Instead of recesses or protuberances of the type shown, metal block structures could be welded to the top of securing portion 22 adjacent to rear edge 36. Such block structures would engage lower ends 42 of the uprights forming the forklift standard and prevent the linking device from disengaging with tines 38.

In the embodiment of FIGS. 8 and 9, having protuberances as interlocking means, securing portion 22 is angled to a lower level near rear edge 36 such that protuberances 48 are below the level of tine-receiving channels 24. This allows the insertion of tines 38 into the channels without interference from protuberances 48.

A wide variety of interlocking means between securing portion 22 and lower ends 42 of the standard uprights 40 are possible. It is only necessary that a portion of horizontal frame 18 extend under uprights 40 and engage them in some manner when horizontal frame 18 is raised on fork tines 38.

While the principles of this invention have been described in connection with specific embodiments, it should be understood clearly that these descriptions are made only by way of example and are not intended to limit the scope of the invention.

What is claimed is:

1. In a forklift linkage device of the type engageable with the forwardly-entending tines of a fork mounted on a carriage which is movable vertically along a standard on a forklift vehicle, the improvement comprising:

a horizontal frame having a front tool-supporting portion and a rear securing portion terminating in a rear edge, the front tool-supporting and the rear securing portions having upper and lower substantially planar portions, respectively, joined in overlapping stepped fashion;

a pair of horizontally directed tine-receiving channels on the frame extending forwardly from openings forward of the rear edge; and means adjacent to the rear edge for male-female mating engagement with lower portions of said standard, such that normal lifting motion of the fork causes such mating engagement and the lowering thereof causes disengagement, whereby a rigid mounting support is provided for said tool.

2. The device of claim 1 wherein the interlocking means comprises mating members on the securing portion rearward of and below the channel openings, said mating members configured and positioned for vertical engagement with the lower ends of uprights forming said standard.

3. The device of claim 2 wherein the mating members are upwardly facing recesses in the securing portion for receiving said lower ends when the horizontal frame is raised.

4. The device of claim 2 wherein the mating members are upwardly-facing protuberances on the securing portion for insertion into openings in said lower ends when the horizontal frame is raised.

5. The device of claim 4 wherein the securing portion is angled to a lower level near the rear edge such that the protuberances thereon are below the level of the tine-receiving channels.

6. The device of claim 1 wherein the tine-receiving channels and at least one cross member therebetween form the upper planar portion.

7. The device of claim 6 wherein the lower planar portion comprises a frame having two parallel members in vertically-offset alignment with the tine-receiving channels.

8. The device of claim 1 wherein the horizontal frame, including the tine-receiving channels, are formed of structural tubes of rectangular cross-section.

9. The device of claim 1 wherein a backhoe is affixed to said front tool-supporting portion.

* * * * *